US006047823A

United States Patent [19]

Deschenes et al.

[11] Patent Number: 6,047,823

[45] Date of Patent: Apr. 11, 2000

[54] METHOD OF MAINTAINING AN ARTICLE OF CLOTHING IN A FOLDED CONDITION AND PLASTIC FASTENER WELL-SUITED FOR USE IN SAID METHOD

[76] Inventors: Charles L. Deschenes, 22 Norton Rd., North Attleboro, Mass. 02760; William J. Cooper, 190 Glen Rd., Woonsocket, R.I. 02895; Clark L. Grendol, 9 Podunk Rd., Sturbridge, Mass. 01566

[21] Appl. No.: 09/151,650

[22] Filed: Sep. 9, 1998

[51] Int. Cl.[7] ..... G09F 3/08

[52] U.S. Cl. ..... 206/338; 206/345; 24/72.7; 24/711.1

[58] Field of Search ..... 24/704.1, 72.7, 24/711.1; 206/338, 340, 343, 345, 346

[56] References Cited

U.S. PATENT DOCUMENTS

| | | | |
|---|---|---|---|
| 3,103,666 | 9/1963 | Bone | 24/711.1 |
| 4,533,076 | 8/1985 | Bourque | 227/67 |
| 5,321,872 | 6/1994 | Merses | 24/704.1 |
| 5,463,799 | 11/1995 | Graham | 24/711.1 |
| 5,593,033 | 1/1997 | Kunreuther | 206/346 |

*Primary Examiner*—Jacob K. Ackun

*Attorney, Agent, or Firm*—Kriegsman & Kriegsman

[57] ABSTRACT

Method of maintaining an article of clothing, such as a dress shirt, in a folded condition and a plastic fastener well-suited for use in the method. According to one embodiment, the plastic fastener is a unitary structure made of polypropylene and comprises a flexible filament having a first cross-bar at a first end thereof and a second cross-bar at a second end thereof. The filament has a length of about 7 mm and has a tensile strength of about 4 pounds. Preferably, the fastener is molded as part of a clip, the clip comprising a plurality of identical such fasteners arranged side-by-side, with the respective first cross-bars parallel to one another and the respective second cross-bars parallel to one another, each of the first cross-bars being joined to a common, orthogonally-disposed runner bar by a severable connector. In use, the clip is loaded into a tagging gun of the type intended for use with runner bar-type clips, the dress shirt is folded in the desired manner, and the first cross-bar of a fastener is dispensed by the tagging gun into and completely through the folded shirt at an appropriate pair of locations, with the second cross-bar not being inserted into the dress shirt. Additional fasteners may be used, where desired, in the same manner to ensure that the shirt remains folded in other areas thereof. To unfold the shirt, one merely pulls apart the two portions of the shirt folded together until the filament of the fastener connecting the two portions breaks.

26 Claims, 2 Drawing Sheets

METHOD OF MAINTAINING AN ARTICLE OF CLOTHING IN A FOLDED CONDITION AND PLASTIC FASTENER WELL-SUITED FOR USE IN SAID METHOD

BACKGROUND OF THE INVENTION

The present invention relates generally to methods of maintaining articles of clothing, such as dress shirts and other fine fabrics, in a folded condition and more particularly to a new method of maintaining an article of clothing in a folded condition and to a plastic fastener well-suited for use in said method.

Certain articles of clothing, most notably men's dress shirts, are often packaged and sold in a folded condition so as to minimize any wrinkling of the article and so as to present the article in an otherwise flattering manner. Typically, the article is maintained in a folded condition by means of one or more straight metal pins, each of said straight metal pins typically comprising an elongated shaft terminating at one end in a sharp tip designed to penetrate the article and at the other end in a rounded head designed not to penetrate the article. Typically in use, the article is folded, and a plurality of said pins are used to maintain the article in its folded condition by securing the article to itself at a plurality of different locations. Often, in the case of men's dress shirts, one or more of said pins are additionally used to secure the shirt to a piece of cardboard or to a similar backing material. The act of using straight metal pins to maintain an article of clothing in a folded condition is typically referred to in the art as "shirt-pinning."

Although straight metal pins have achieved widespread use in maintaining articles of clothing in a folded condition, certain shortcomings are associated therewith. One such shortcoming is that no suitable tool exists for dispensing such pins into an article of clothing; consequently, the pins must be inserted manually. As can readily be appreciated, the repeated insertion of such pins into articles of clothing, over time, can become both physically and mentally taxing. Another shortcoming associated with the use of straight metal pins is that the pins, as noted above, have sharp ends, which can cause injury both to the person who must insert the pin into the article and to the person (i.e., consumer) who must remove the pin from the article. Moreover, once the pins are removed from the article, they must be disposed of properly to avoid injury to others. Still another shortcoming associated with the use of straight metal pins is that such pins, when inserted, may cause damage to the article, either by snagging and tearing the article or by creating a conspicuous insertion hole in the article. Still yet another shortcoming associated with the use of straight metal pins is that such pins, once inserted into an article of clothing, can be difficult to access and manipulate in such a way as to enable their removal.

Plastic fasteners of the type comprising an elongated flexible filament having a first cross-bar at one end and a paddle or a second cross-bar at the opposite end are well-known and have been widely used in the attachment of merchandise tags to articles of commerce, as well as in other types of applications, such as in shoe-lasting and in packaging applications. Typically, such plastic fasteners are mass-produced by molding processes into either one of two different types of assemblies. One such assembly, an example of which is disclosed in U.S. Pat. No. 3,103,666, inventor Bone, issued Sep. 17, 1963 (which patent is incorporated herein by reference), is a clip-type assembly, said clip comprising a plurality of fasteners, each such fastener comprising a flexible filament having a first cross-bar at one end thereof and a paddle or second cross-bar at the opposite end thereof. The fasteners are arranged side-by-side, with the respective first cross-bars parallel to one another and the respective paddles or second cross-bars parallel to one another, each of the first cross-bars being joined to a common, orthogonally-disposed runner bar by a severable connector.

Several commercial embodiments of the aforementioned fastener clip have been sold by the present assignee, Avery Dennison Corporation, as DENNISON® SWIFTACH® fastener clips. DENNISON® SWIFTACH® fastener clips comprising fasteners of the type having a cross-bar at one end of a flexible filament and a paddle at the opposite end of the flexible filament are generally made of polypropylene or nylon and are typically used to attach merchandise tags and the like to articles of clothing. The filaments of such fasteners are typically at least about 12.5 mm in length. DENNISON® SWIFTACH® fastener clips comprising fasteners of the type having a first cross-bar at one end of a flexible filament and a second cross-bar at the opposite end of the flexible filament are made of nylon and are used to attach merchandise tags and the like to a wide variety of articles of commerce. In addition, such fasteners are used in shoe-lasting applications and in packaging applications, where the high tensile strength afforded by the use of nylon in the fastener is desirable. The filaments of such fasteners are typically at least about 6.35 mm in length.

As far as the present inventors are aware, the above-described fastener clip, exemplified by the family of DENNISON® SWIFTACH® fastener clips, has not been used to maintain an article of clothing, such as a dress shirt, in a folded condition.

A second type of fastener assembly, an example of which is disclosed in U.S. Pat. No. 4,533,076, inventor Bourque, issued Aug. 6, 1985 (which patent is incorporated herein by reference), is known as continuously connected fastener stock. In one type of continuously connected stock, the fasteners comprise a flexible filament having a cross-bar at one end thereof and a paddle at the opposite end thereof, the respective cross-bars and paddles of successive fasteners being arranged end-to-end and being joined together by severable connectors. In another type of continuously connected fastener stock, often referred to as "plastic staples," the fasteners comprise a flexible filament having a first cross-bar at one end thereof and a second cross-bar at the opposite end thereof, the respective first cross-bars and second cross-bars of successive fasteners being arranged end-to-end and being joined together by severable connectors. Plastic staples are typically made of polyurethane and are often used to attach tags, at two distinct points, to pants and similar clothing articles.

Tools (often referred to as "tagging guns") for dispensing individual fasteners from multi-fastener assemblies of the two different types described above are known, examples of such tools being disclosed in U.S. Pat. Nos. 5,024,365, 4,533,076, 4,456,161, 4,121,487, and U.S. Pat. No. 4,456,123, all of which are incorporated herein by reference, and including the Dennison™ Mark II™ SWIFTACH® tools.

It is the understanding of the present inventors that, for a limited time in the past, a third party used plastic staples to "pin" shirts, albeit not dress shirts or other shirts of a fine material, so as to maintain the shirts in a folded condition. It is the belief of the present inventors that the aforementioned securing was achieved using a dual needle fastener dispensing tool of the type disclosed in U.S. Pat. No.

4,533,076 and was performed by folding the shirt, inserting both needles of the tool entirely through the folded-over portion of the article and then dispensing both cross-bars through the needles and the folded article so that both cross-bars were positioned on one side of the article, with the filament connecting the two cross-bars extending over to the opposite side of the article. It is further believed by the present inventors that the aforementioned use of plastic staples to "pin" shirts was discontinued because the plastic staples did not have sufficient tensile strength to maintain the shirt in its folded condition (plastic staples typically having a tensile strength of about 1.2–1.4 pounds).

SUMMARY OF THE INVENTION

It is an object of the present invention to provide a new method of maintaining an article of clothing, such as a men's (or women's) dress shirt, in a folded condition.

It is another object of the present invention to provide a method as described above that does not involve the use of metal pins.

It is yet another object of the present invention to provide a method as described above that involves the use of a plastic fastener.

It is still yet another object of the present invention to provide a method as described above that involves the use of a plastic fastener that can be dispensed from a fastener assembly using a fastener dispensing tool.

It is a further object of the present invention to provide a plastic fastener well-suited for use in the above-described method.

The present inventors have determined that, for a plastic fastener to be suitable for maintaining an article of clothing, such as a men's (or women's) dress shirt, in a folded condition, the plastic fastener should preferably have a tensile strength that is great enough to keep the article folded during shipping and handling, and at the same time, have a tensile strength that is weak enough so that, when a person wishes to unfold the article (typically by pulling apart the fastened-together portions of the article), the filament portion of the fastener breaks before the fastener can be pulled, intact, through the article (in which case it may possibly cause damage the article). The present inventors have further determined that, to achieve the above objectives, the tensile strength of the fastener should be in the range of about 75%–80% of that of the material used to make the folded article of clothing. Where the article of clothing being maintained in a folded condition is a dress shirt (men's or women's) or a like fine fabric, the present inventors believe that a tensile strength of about 2–4 pounds is preferred.

Additional objects, features, aspects and advantages of the present invention will be set forth, in part, in the description which follows and, in part, will be obvious from the description or may be learned by practice of the invention. In the description, reference is made to the accompanying drawings which form a part thereof and in which is shown by way of illustration specific embodiments for practicing the invention. These embodiments will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

The accompanying drawings, which are hereby incorporated into and constitute a part of this specification, illustrate preferred embodiments of the invention and, together with the description, serve to explain the principles of the invention. In the drawings wherein like reference numerals represent like parts.

DETAILED DESCRIPTION OF PREFERRED EMBODIMENTS

Figure 1:
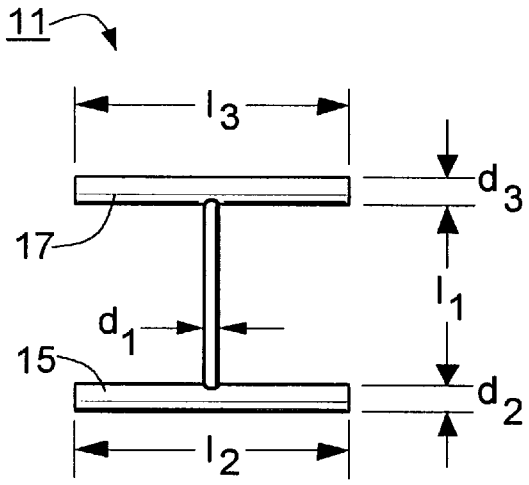
FIG. 1 is a front view of a first embodiment of a plastic fastener well-suited for maintaining a dress shirt in a folded condition, said plastic fastener being constructed according to the teachings of the present invention.

Referring now to FIG. 1, there is shown a front view of one embodiment of a plastic fastener that is well-suited for maintaining a dress shirt in a folded condition, the plastic fastener being constructed according to the teachings of the present invention and being represented generally by reference numeral 11.

Fastener 11, which is a unitary structure preferably made by molding, comprises a flexible filament 13. Filament 13, which is generally circular in transverse cross-section, has a length $l_1$ of approximately 7.14 mm and a diameter $d_1$ of approximately 0.58 mm.

Fastener 11 also comprises a first cross-bar 15, cross-bar 15 being disposed at a first end of filament 13. Cross-bar 15, which is generally circular in transverse cross-section, has a length 12 of approximately 7.87 mm and a diameter $d_2$ of approximately 0.79 mm.

Fastener 11 further comprises a second cross-bar 17, cross-bar 17 being disposed at a second end of filament 13. Cross-bar 17, which is generally circular in transverse cross-section, has a length $l_3$ of approximately 7.11 mm and a diameter $d_3$ of approximately 0.97 mm.

Fastener 11 is preferably made of a polypropylene that gives filament 13 a tensile strength of about 4 pounds. However, it is to be noted that said polypropylene is not the only type of material of which fastener 11 may be made and that other plastic materials (or combinations of materials) capable of providing filament 13 with a tensile strength in the range of about 2–4 pounds are also suitable for purposes of the present invention. By way of comparison, it is to be noted that if fastener 11 were to be made of nylon, filament 13 would likely have a tensile strength in the range of about 8 pounds, which would not be suitable for "pinning" dress shirts, although it may be suitable for pinning other articles of clothing.

Figure 2:
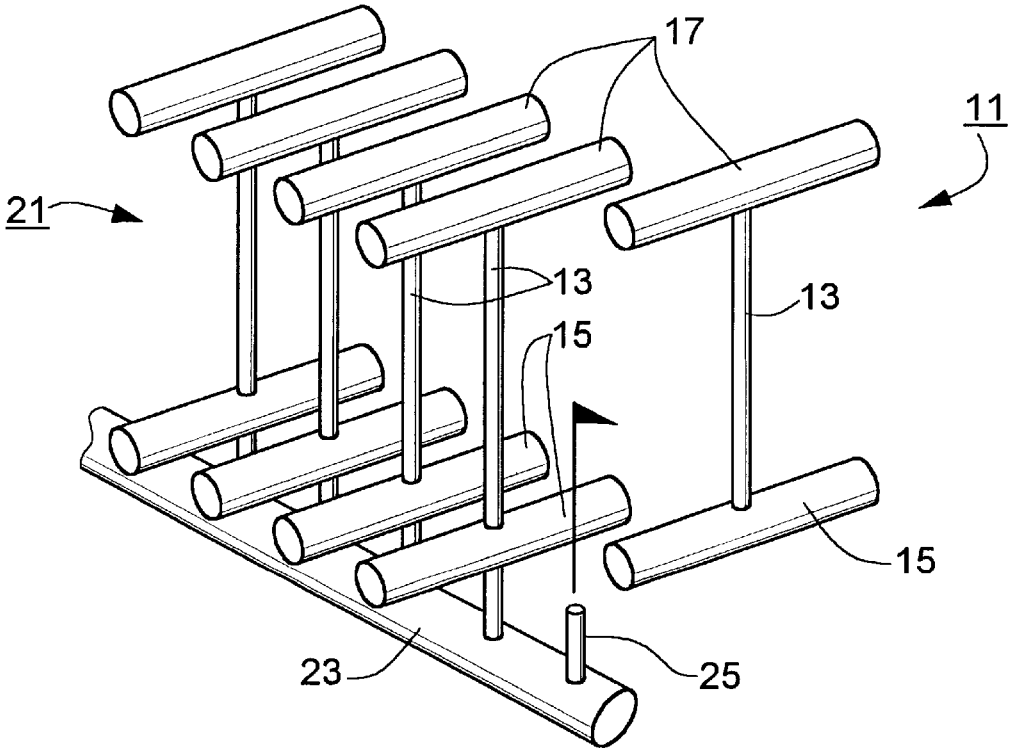
FIG. 2 is a fragmentary, perspective view of a first embodiment of a fastener clip constructed according to the teachings of the present invention, the fastener clip comprising a plurality of the plastic fasteners of FIG. 1.

Referring now to FIG. 2, there is shown a perspective view of a first embodiment of a fastener clip constructed according to the teachings of the present invention, the fastener clip being represented generally by reference numeral 21.

Clip 21, which is a unitary structure preferably made by molding, comprises a plurality of fasteners 11. Fasteners 11 are arranged in a side-by-side orientation, with the respective first cross-bars 15 parallel to one another and the respective second cross-bars 17 parallel to one another, each of first cross-bars 15 being joined to a common, orthogonally-disposed runner bar 23 by a severable connector 25.

Individual fasteners 11 may be dispensed from clip 21 using a conventional tagging gun of the type adapted to dispense fasteners from a runner bar-type clip.

To use fasteners 11 of a clip 21 to maintain a dress shirt or a like article of clothing in a folded condition, one loads clip 21 into an appropriate tagging gun and dispenses the first cross-bar 15 of a fastener 11 into and completely through the folded shirt at an appropriate pair of locations, with the second cross-bar 17 not being inserted into the dress shirt. Additional fasteners may be used, where desired, in the same manner to ensure that the shirt remains folded in other areas thereof. When one finishes attaching fasteners 11 to the dress shirt, the dress shirt will resist unfolding due to normal shipping and handling. When it is desired unfold the shirt, one merely pulls apart the two "pinned-together" portions of the shirt until the filament 13 of the fastener 11 connecting the two portions breaks.

As can readily be appreciated, it is not essential that cross-bar 17 of fastener 11 be circular in transverse cross-section or, in fact, that it be shaped as a cross-bar. Instead, all that is required is that whatever element is at the second end of filament 13 be of such a shape that it will prevent filament 13 from being inserted completely through the pinned article. However, such an element will preferably have an unobtrusive appearance. Accordingly, said element could have the shape of the head of a pin or the like.

As can also readily be appreciated, it is not essential that cross-bar 15 of fastener 11 be circular in transverse cross-section or, in fact, that it be shaped as a cross-bar. Instead, all that is practically required is that whatever element is at the first end of filament 13 be of such a shape that will allow it to be dispensed from a tagging gun and that will prevent withdrawal of such an element from the shirt through which it has been inserted.

Figure 3A:
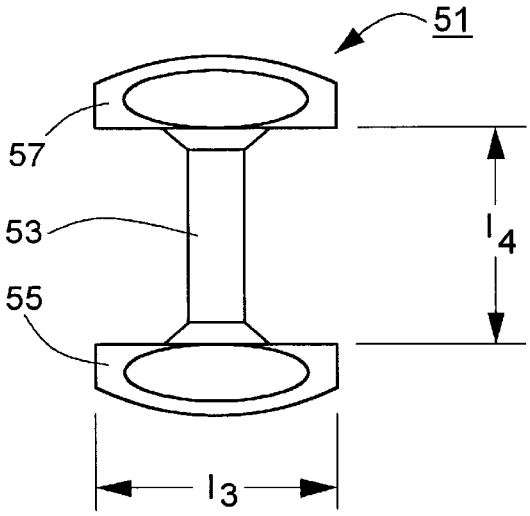
FIGS. 3(*a*) through 3(*c*) are front, top and side views, respectively, of a second embodiment of a plastic fastener well-suited for maintaining a dress shirt in a folded condition, said plastic fastener being constructed according to the teachings of the present invention.
Figure 3C:
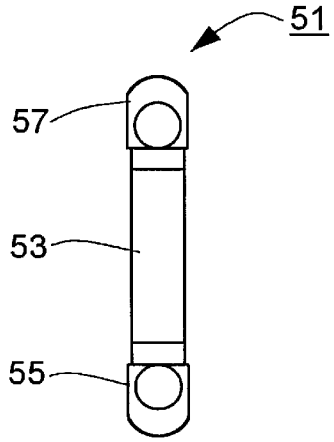
Figure 3B:
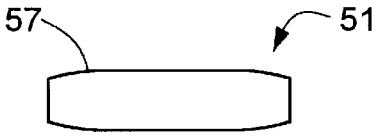

Referring now to FIGS. 3(*a*) through 3(*c*), there are shown front, top and side views, respectively, of a second embodiment of a plastic fastener well-suited for maintaining a dress shirt in a folded condition, said plastic fastener being constructed according to the teachings of the present invention and being represented generally by reference numeral 51.

Fastener 51, which is a unitary structure preferably made by molding, comprises a flexible filament 53. Filament 53 has a length 14 of approximately 3.3 mm.

Fastener 51 also comprises a first cross-bar 55, cross-bar 55 being disposed at a first end of filament 53, and a second cross-bar 57, cross-bar 57 being disposed at a second end of filament 53. Cross-bars 55 and 57 each has a length 13 of approximately 1.78 mm.

Fastener 51 is preferably made of a polyurethane that gives filament 53 a tensile strength of about 2 pounds. However, it is to be noted that said polyurethane is not the only type of material of which fastener 51 may be made and that other plastic materials (or combinations of materials) capable of providing filament 53 with a tensile strength in the range of about 2–4 pounds are also suitable for purposes of the present invention. It is to be noted that, because filament 53 is made of a polyurethane, it has an elasticity that filament 13 of polypropylene fastener 11 does not.

Figure 4:
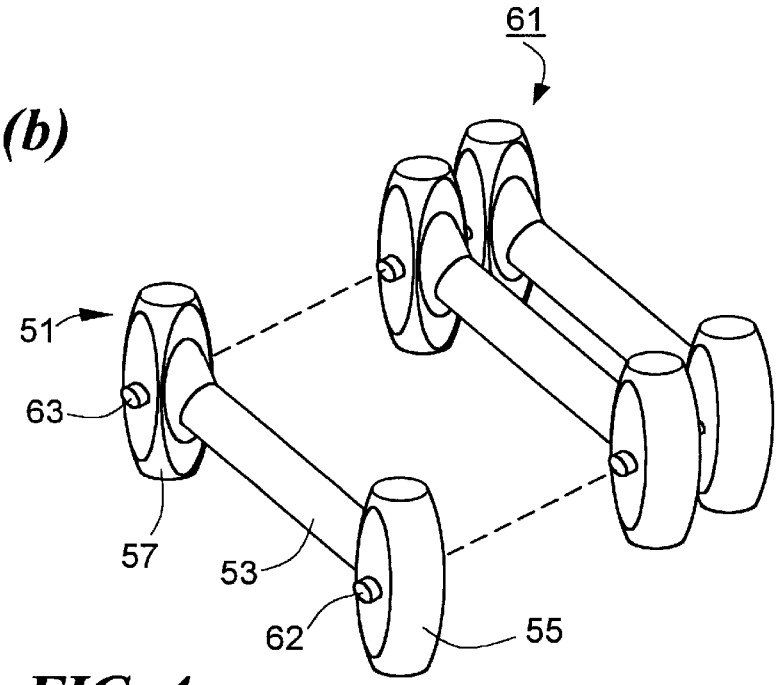
FIG. 4 is a fragmentary, perspective view of a second embodiment of a fastener clip constructed according to the teachings of the present invention, the fastener clip comprising a plurality of the plastic fasteners of FIG. 3(*a*).

FIG. 4 is a fragmentary, perspective view of a second embodiment of a fastener clip constructed according to the teachings of the present invention, the fastener clip being represented generally by reference numeral 61.

Clip 61, which is a unitary structure preferably made by molding, comprises a plurality of fasteners 51. Severable connectors 62 connect the respective cross-bars 55 of fasteners 51, and severable connectors 63 connect the respective cross-bars 57 of fasteners 51. As can be seen, clip 61 does not include a runner bar.

The embodiments of the present invention recited herein are intended to be merely exemplary and those skilled in the art will be able to make numerous variations and modifications to it without departing from the spirit of the present invention. All such variations and modifications are intended to be within the scope of the present invention as defined by the claims appended hereto.

What is claimed is:

1. A plastic fastener well-suited for maintaining a dress shirt in a folded condition, said plastic fastener comprising:

(a) a flexible filament, said flexible filament having a first end and a second end, said flexible filament having a tensile strength of about 2–4 lbs;

(b) a first cross-bar disposed at said first end; and (c) a second cross-bar disposed at said second end.

2. The plastic fastener as claimed in claim 1 wherein said flexible filament, said first cross-bar and said second-bar form a unitary structure made of molded polypropylene.

3. The plastic fastener as claimed in claim 1 wherein said flexible filament, said first cross-bar and said second-bar form a unitary structure made of molded polyurethane.

4. The plastic fastener as claimed in claim 1 wherein said flexible filament has a length of about 6–8 mm.

5. The plastic fastener as claimed in claim 1 wherein said flexible filament has a length of about 3.3 mm.

6. The plastic fastener as claimed in claim 2 wherein said flexible filament has a length of about 6–8 mm.

7. The plastic fastener as claimed in claim 3 wherein said flexible filament has a length of about 3.3 mm.

8. The plastic fastener as claimed in claim 6 wherein said flexible filament has a tensile strength of about 4 lbs.

9. The plastic fastener as claimed in claim 7 wherein said flexible filament has a tensile strength of about 2 lbs.

10. A fastener clip, said fastener clip comprising a plastic fastener as claimed in claim 1 and a runner bar, said first cross-bar being severably connected to said runner bar.

11. A fastener clip, said fastener clip comprising two identical plastic fasteners of the type claimed in claim 1, a first severable connector connecting the respective first cross-bars of the two identical plastic fasteners and a second severable connector connecting the respective second cross-bars of the two identical plastic fasteners.

12. A plastic fastener well-suited for maintaining a dress shirt in a folded condition, said plastic fastener comprising:

(a) a flexible filament, said flexible filament having a first end and a second and, said flexible filament having a tensile strength of about 2–4 lbs. and a length of about 3–8 mm;

(b) an inserting element disposed at said first end, said inserting element being dimensioned to permit its insertion through a folded dress shirt, and once inserted therethrough, to be retained by said folded dress shirt; and (c) a retaining element disposed at said second end, said retaining element being dimensioned to prevent said flexible filament from being pulled completely through the folded dress shirt.

13. The plastic fastener as claimed in claim 12 wherein said flexible filament has a length of about 3.3 mm.

14. The plastic fastener as claimed in claim 12 wherein said flexible filament has a length of about 6–8 mm.

15. The plastic fastener as claimed in claim 14 wherein said flexible filament has a length of about 7.14 mm.

16. The plastic fastener as claimed in 13 wherein said flexible filament, said inserting element and said retaining element form a unitary structure made of molded polyurethane.

17. The plastic fastener as claimed in 15 wherein said flexible filament, said inserting element and said retaining element form a unitary structure made of molded polypropylene.

18. The plastic fastener as claimed in claim 14 wherein said inserting element is a cross-bar.

19. The plastic fastener as claimed in claim 14 wherein said retaining element is a cross-bar.

20. A method of maintaining an article of clothing in a folded condition, said method comprising the steps of:

(a) providing a plastic fastener, said plastic fastener comprising
  (i) a flexible filament, said flexible filament having a first end and a second end,
  (ii) a first cross-bar disposed at said first end, and
  (iii) a second cross-bar disposed at said second end;

(b) folding the article of clothing; and (c) inserting the first cross-bar of said plastic fastener into and completely through the folded article at an appropriate pair of locations therein, with said second cross-bar not being inserted into the article.

21. The method as claimed in claim 20 wherein the flexible filament has a tensile strength that is great enough to keep the article folded during shipping and handling, and yet, has a tensile strength that is weak enough so that, when a person wishes to unfold the article by pulling apart the fastened-together portions of the article, the flexible filament breaks before the plastic fastener can be pulled, intact, through the article.

22. The method as claimed in claim 21 wherein the article of clothing is a dress shirt.

23. The method as claimed in claim 22 wherein the flexible filament has a tensile strength of about 2–4 lbs.

24. The method as claimed in claim 23 wherein the flexible filament has a tensile strength of about 4 lbs and has a length of about 6–8 mm and wherein the plastic fastener is made of polypropylene.

25. The method as claimed in claim 23 wherein the flexible filament has a tensile strength of about 2 lbs and has a length of about 3 mm and wherein the plastic fastener is made of polyurethane.

26. A method of maintaining an article of clothing in a folded condition, said method comprising the steps of:

(a) providing a plastic fastener, said plastic fastener comprising
  (i) a flexible filament, said flexible filament having a first end and a second end,
  (ii) an inserting element disposed at said first end, said inserting element being dimensioned to enable its insertion through the article of clothing and once inserted therethrough to be retained by the article of clothing, and
  (iii) a retaining element disposed at said second end, said retaining element being dimensioned to prevent said flexible filament from being pulled completely through the article of clothing;

(b) folding the article of clothing; and (c) inserting said inserting element of said plastic fastener into and completely through the folded article at an appropriate pair of locations therein, with said retaining element not being inserted into the article.

* * * * *